US009309071B2

(12) United States Patent
Ishihara

(10) Patent No.: US 9,309,071 B2
(45) Date of Patent: Apr. 12, 2016

(54) CONVEYING APPARATUS AND RECORDING APPARATUS

(75) Inventor: Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/586,154

(22) Filed: Aug. 15, 2012

(65) Prior Publication Data

US 2013/0043645 A1 Feb. 21, 2013

(30) Foreign Application Priority Data

Aug. 19, 2011 (JP) ..... 2011-179471

(51) Int. Cl.
*B65H 3/06* (2006.01)
*B65H 5/06* (2006.01)

(52) U.S. Cl.
CPC ..... *B65H 5/062* (2013.01); *B65H 3/0684* (2013.01); *B65H 2404/152* (2013.01); *B65H 2404/1521* (2013.01); *B65H 2404/6111* (2013.01); *B65H 2701/171* (2013.01)

(58) Field of Classification Search
CPC ..... B65H 5/062; B65H 3/0684; B65H 2404/152; B65H 2404/1521; B65H 2404/6111; B65H 2701/171
USPC ..... 271/272–274
See application file for complete search history.

(56) References Cited

U.S. PATENT DOCUMENTS

| | | | | |
|---|---|---|---|---|
| 6,042,112 | A * | 3/2000 | Izumi | 271/273 |
| 7,458,577 | B2 * | 12/2008 | Terada | 271/273 |
| 7,591,467 | B2 * | 9/2009 | Terada | 271/274 |
| 7,641,193 | B2 * | 1/2010 | Barinaga et al. | 271/277 |
| 7,988,149 | B2 * | 8/2011 | Terada | 271/272 |
| 8,007,100 | B2 * | 8/2011 | Ishihara et al. | 347/104 |
| 8,215,636 | B2 * | 7/2012 | Youn | 271/162 |
| 8,322,715 | B2 * | 12/2012 | Mandel et al. | 271/264 |
| 8,387,979 | B2 * | 3/2013 | Nagura et al. | 271/274 |
| 2007/0145678 | A1 * | 6/2007 | Terada | 271/272 |
| 2007/0145679 | A1 * | 6/2007 | Terada | 271/272 |
| 2010/0244374 | A1 * | 9/2010 | Terada | 271/273 |
| 2011/0115148 | A1 * | 5/2011 | Nakaishi | 271/109 |

FOREIGN PATENT DOCUMENTS

| | | | |
|---|---|---|---|
| JP | 2003-171046 | A | 6/2003 |
| JP | 2007-119126 | A | 5/2007 |
| JP | 2008-285322 | A | 11/2008 |
| JP | 2009-091142 | A | 4/2009 |
| JP | 2010-150030 | A | 7/2010 |
| JP | 4646435 | B2 | 3/2011 |
| JP | 2011-136828 | A | 7/2011 |

* cited by examiner

*Primary Examiner* — Patrick Cicchino
(74) *Attorney, Agent, or Firm* — Canon U.S.A., Inc. IP Division

(57) ABSTRACT

A conveying apparatus includes a sheet conveyance path including a curved portion, and a roller pair that is located along the conveyance path and conveys a sheet. At least one of rollers of the roller pair moves such that the orientation of conveying force exerted onto the sheet by the roller pair at its nip point is changed after the roller pair pinches the sheet.

11 Claims, 19 Drawing Sheets

CONVEYING APPARATUS AND RECORDING APPARATUS

BACKGROUND OF THE INVENTION

1. Field of the Invention

The present invention relates to a conveying apparatus mounted in a recording apparatus to convey sheets.

2. Description of the Related Art

One type of conveying apparatuses used in recording apparatuses picks up a plurality of sheets one by one that are stacked in a paper feed tray in the front portion of the recording apparatus and inverses the conveying direction of the sheets using a curved conveyance path (hereinafter, referred to as "U-turn path") to convey them to a recording unit of the recording apparatus. An image reading and recording apparatus that uses such a conveying apparatus is discussed in Japanese Patent Application Laid-Open No. 2010-150030. Hereinafter, the conveyance to pass sheets through such a U-turn path is referred to as "U-turn conveyance."

The sheets, which are picked up from the paper feed tray and conveyed to the recording unit, pass the U-turn path one by one. Sheets having higher stiffness cannot be conveyed along the shape of the U-turn path, resulting in jamming of the sheet, or resistance against the sheet conveyance is generated due to increase in friction between the sheets and the U-turn path.

If a conveyance resistance is large, for example, when a feeding roller has a power insufficient to successfully convey the sheet from the paper feed tray to the recording unit, slippage occurs between the feeding roller and the sheets. If an output from a drive source of the feeding roller is not large enough, the feeding roller cannot receive a driving force that overcomes the conveyance resistance, making the sheets jammed within the U-turn path. In addition, other troubles may occur, such as buckling of the sheets because the sheets cannot endure the conveyance resistance from the U-turn path and the compression force due to the conveying force of the feeding roller.

Accordingly, in a conveying apparatus that utilizes U-turn conveyance, a feeding roller is arranged upstream of a U-turn path in the conveying direction of sheets, and also one or more intermediate rollers are arranged within the U-turn path as needed. The intermediate rollers disposed near the curved portion of the U-turn path allow sheets to be conveyed in the direction along a shape of the U-turn path.

FIG. 18 schematically illustrates arrangement of conveyed sheets and an intermediate roller pair. In FIG. 18A, a first roller 1001 protrudes in a large amount from a guide surface. In FIG. 18B, a first roller 1001 protrudes in a small amount from a guide surface. FIG. 18 illustrates only apparatus members necessary for description. FIG. 18 does not illustrate an inner guide that forms the U-turn path and is located in the curving direction (i.e., on the inner periphery side) of a U-turn path, but illustrates only an outer guide opposite the inner guide (i.e., on the outer periphery side).

The first roller 1001 and a second roller 1002 form an intermediate roller pair located in the U-turn path. An upstream guide 1005 is disposed upstream, and a downstream guide 1004 is disposed downstream in the sheet conveying direction of the intermediate roller pair. The arrow 1007 in FIG. 18 illustrated by a solid line indicates a sheet conveying direction along which sheets are conveyed to the intermediate roller pair, and the arrow 1003 illustrated by a broken line indicates the nip direction of the intermediate roller pair.

The nip direction herein is oriented perpendicular to a straight line between the rotation axes of two rollers 1001 and 1002 within a cross section surface perpendicular to the rotation axes of the two rollers 1001 and 1002. In addition, the nip direction extends from an upstream to downstream side of the intermediate roller pair. An extended plane 1011 from the upper surface of the upstream guide 1005 forms an approach angle 1008 with a tangent 1010 running on the intersection between the extended plane 1011 and the surface of the first roller 1001. The first roller 1001 produces an amount of protrusion 1006 from the extension of the plane 1011 of the upper surface in the upstream guide 1005.

When a sheet is conveyed by a feeding roller (not illustrated) to the U-turn path, the sheet's leading edge is caused to advance subject to its stiffness along the outer guide. Thus, the sheet advances along the upstream guide 1005 in the direction illustrated by the arrow 1007. As illustrated in FIG. 18A, if the sheet conveying direction 1007 forms a large angle 1009 with the nip direction 1003, the approach angle 1008 relative to the first roller 1001 becomes large. In this case, before the sheet is drawn into the nip between the intermediate roller pair, the sheet's leading edge collides against the first roller 1001, which may cause damage to the sheet's leading edge or failure in conveyance, for example, the sheet is not drawn into the nip.

In order to reduce the collision impact of the sheet against the first roller 1001 without changing the angle 1009 between the sheet conveying direction 1007 and the nip direction 1003, as illustrated in FIG. 18B, the amount of protrusion 1006 of the first roller 1001 needs to be reduced as compared to the case in FIG. 18A. As the amount of protrusion 1006 is reduced, the approach angle 1008 of the sheet to the first roller 1001 is reduced. However, in this case, it is also likely that the sheet collides against the second roller 1002 before reaching the nip between the intermediate roller pair. Accordingly, this case also tends to cause failure in conveyance of sheets.

Therefore, in order to make a sheet's leading edge smoothly drawn into the nip between the intermediate roller pair, when the intermediate roller is arranged within the U-turn path, it is desirable that the nip direction 1003 of the intermediate roller pair is similar to the sheet conveying direction 1007 in the upstream side of the intermediate roller pair.

In conveying the sheets using the intermediate roller pair, if the nip direction 1003 of the intermediate roller pairs is almost perpendicular to the surface of the downstream guide 1004 (see FIG. 19A), the sheet conveying direction 1007 needs to be significantly bent. As a result, the conveyed sheet needs to be bent in a large amount. Hence, the amount of bending of the sheet is smaller in the structure (see FIG. 19B) where the nip direction 1003 of the intermediate roller pair follows the curved U-turn path (in a direction to the inner side). The larger an amount of bending of a sheet, the larger friction between the sheet and the U-turn path due to stiffness of the sheet, which leads to increase in conveyance resistance. Accordingly, to avoid the conveyance resistance, it is desirable to arrange the nip direction 1003 of the intermediate roller pair to follow the curved U-turn path.

However, it is very difficult to arrange the nip direction 1003 of the intermediate roller pair within the curved U-turn path to satisfy the above two conditions.

To solve the problem, for example, a plurality of intermediate roller pairs can be arranged within the U-turn path such that the nip directions of each intermediate roller pair are changed little by little. However, this method increases the number of rollers, increasing manufacturing cost and size of the conveying apparatus.

Alternatively, the nip pressure of an intermediate roller pair can be increased to enable conveyance of sheets despite of conveyance resistance from the U-turn path. However, this method increases the load on a driving unit that drives intermediate rollers, or tends to cause troubles such as deformation of components that support the rollers, which require a larger power source for the driving unit and enhancement of the strength of the roller supporting components. As a result, the increase in nip pressure also increases manufacturing cost as in the above case.

SUMMARY OF THE INVENTION

The present invention is directed to a conveying apparatus that smoothly conveys sheets along a curved conveyance path.

A conveying apparatus of an aspect of the present invention includes a sheet conveyance path includes a curved portion, a roller pair that rotates at the curved portion or near the curved portion while pinching a sheet, and a mechanism that causes at least one of rollers included in the roller pair to move after the roller pair pinches the sheet.

According to an aspect of the present invention, failure in drawing the sheet into rollers and failure in sheet conveyance due to loads caused by conveyance resistance, for example, can be prevented in a roller pair located on a curved conveyance path.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
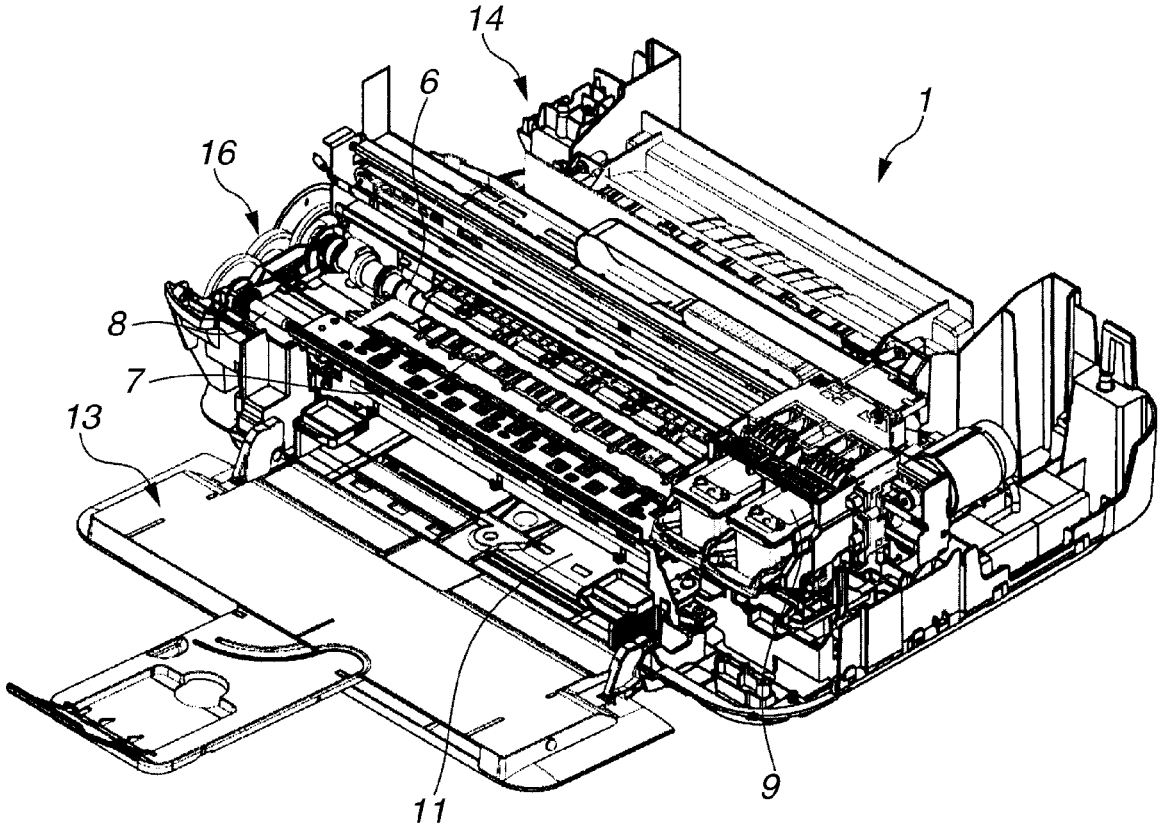
FIG. 1 is a perspective view illustrating a conveying apparatus according to a first exemplary embodiment of the present invention, and a recording apparatus having the conveying apparatus.

Various exemplary embodiments, features, and aspects of the invention will be described in detail below with reference to the drawings. The structures of similar functions are given with the same reference numerals, and redundant description thereof may be avoided below.

Figure 2:
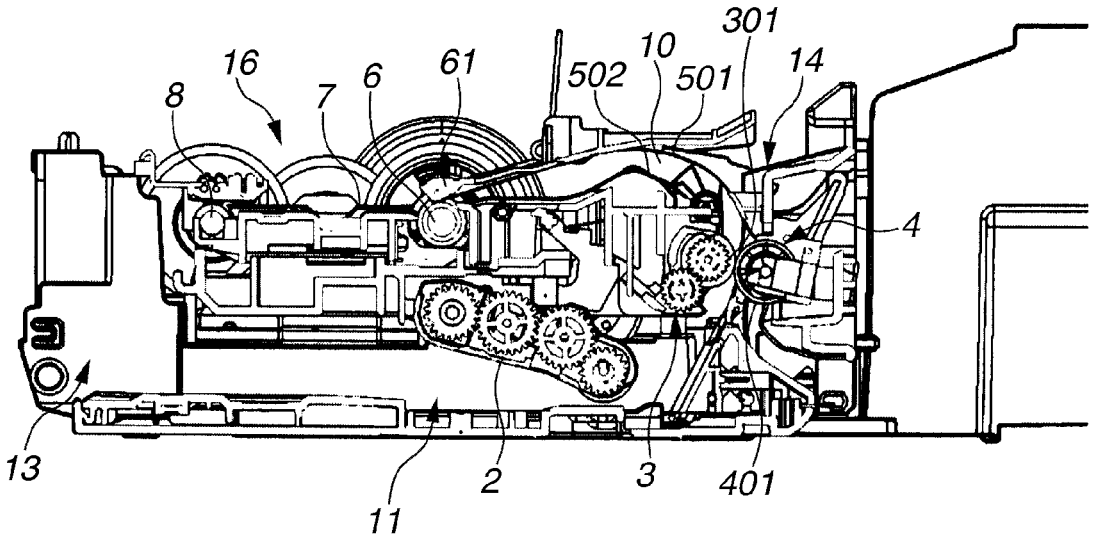
FIG. 2 is a cross sectional view of the recording apparatus in FIG. 1.

FIG. 1 is a perspective view illustrating a conveying apparatus according to a first exemplary embodiment of the present invention, and a recording apparatus having the conveying apparatus. FIG. 2 is a cross sectional view of the recording apparatus in FIG. 1. In FIG. 2, a discharge tray 13 illustrated in FIG. 1 is folded up.

An ink-jet recording apparatus is described in the present invention, as an example of an apparatus in which a conveying apparatus according to the present invention is used. However, the conveying apparatus can be used in any type of recording apparatuses other than ink-jet recording apparatuses, or in apparatuses other than recording apparatuses. Further, the conveyance path merely needs to have a curved portion, and sheet feeding can be performed using an automatic sheet feeder (ASH) as discussed in Japanese Patent No. 4646435, for example. In addition, the sheets are not particularly limited, and can be of any type including paper and overhead projector (OHP) sheets.

A conveying apparatus mounted in a recording apparatus 1 of the present invention includes a paper feed tray 11 in which sheets having a sheet shape are stacked. Downstream of the paper feed tray 11 in a sheet conveying direction, a reversing conveyance unit 14, a horizontal conveyance unit 16, and a discharge tray 13 are arranged in sequence.

Between the paper feed tray 11 having sheets stacked therein and the reversing conveyance unit 14, a feeding roller arm unit 2 is disposed. The feeding roller arm unit 2 comes in contact with a sheet at the topmost of the sheet stack in the paper feed tray 11 to pick it up and convey it to the reversing conveyance unit 14.

The reversing conveyance unit 14 includes a curved conveyance path (hereinafter, referred to as "U-turn path") 10 of almost U-shape. The sheet, after conveyed to the reversing conveyance unit 14, passes through the U-turn path 10, so that the conveying direction of the sheet is inversed, and the sheet is conveyed to the horizontal conveyance unit 16 in a reversed state. In other words, U-turn conveyance is performed on the sheet through the U-turn path 10.

The U-turn path 10 is mainly configured with an inner guide 502 disposed inside of the curve, that is, on the inner periphery side of the path 10, and an outer guide 501 disposed opposite the inner guide 502 on the outer periphery side of the path 10. The reversing conveyance unit 14 includes an intermediate roller pair (i.e., a roller pair) including a drive roller 301 in a drive roller arm unit 3 and a driven roller 401 in a driven roller arm unit 4. The intermediate roller pair pinches and conveys a sheet at the curved portion or a portion near the curved portion of the U-turn path 10.

The recording apparatus 1 includes a recording unit configured to record images on sheets in the horizontal conveyance unit 16. The recording unit includes a platen 7 to hold sheets, and a recording head unit 9 that is able to scan sheets at a position opposite to and separated from the platen 7. Sheets are conveyed by a conveyance roller pair of a conveyance roller 6 and a pinch roller 61 in horizontal conveyance unit 16. While being conveyed, the recording head unit 9 forms images onto the sheets, and the sheet discharge roller 8 discharges them to the discharge tray 13.

Figure 11:
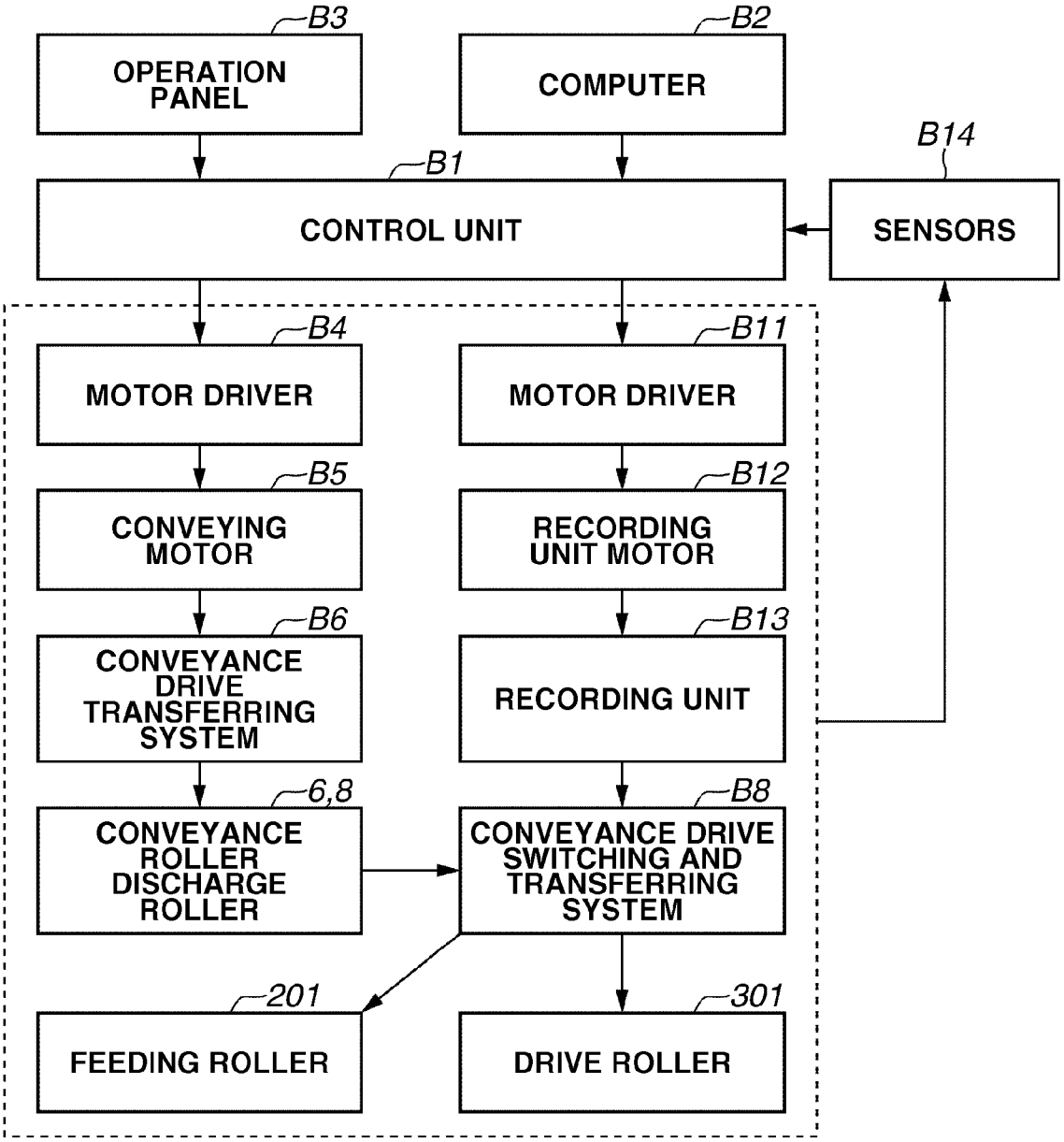
FIG. 11 is a control block diagram illustrating a recording apparatus.

FIG. 11 is a control block diagram illustrating a recording apparatus. A control unit B1 includes an interface unit, and receives commands for recording from a computer B2 and an operation panel B3 which are connected to the control unit B1 through the interface unit. Alternatively, the control unit B1 uses a timer incorporated therein to start recording operations. The control unit B1 then issues a command to supply electric power through a conveying motor driver B4, to a conveying motor B5. The conveying motor B5 is connected to a conveying drive transferring system B6. The conveyance roller 6 and the sheet discharge roller 8, after receiving a driving force from the conveying motor B5 through the conveying drive transferring system B6, transfers the driving force to the conveyance drive switching and transferring system B8, while conveying the sheets in the recording.

At the same time, The control unit B1 issues a command to supply electric power through a recording unit motor driver B11, to a recording unit motor B12 connected to a recording unit B13. The recording unit B13 is connected such that it can switch driving states of the conveyance drive switch and transferring system B8.

The conveyance drive switch and transferring system B8 transfer or block the driving force transmitted from the conveyance roller 6 and the sheet discharge roller 8 depending on operations of the recording unit B13, and switches its rotation direction to transfer the driving force to the feeding roller 201 and the drive roller 301.

The rotation state and loaded condition of each motor and the conveyance state of sheets are detected by sensors B14 mounted to various positions in the conveying apparatus. The detected information is sent to the control unit B1 as signals. The control unit B1 then controls each motor based on commands and the information from the sensors B14 to perform recording.

Figure 3:
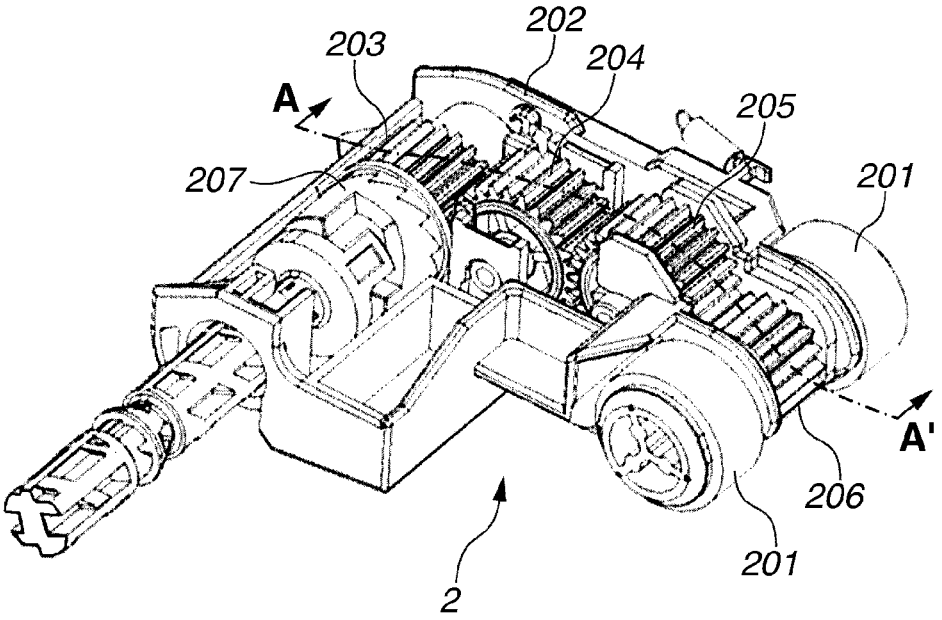
FIG. 3 is a perspective view illustrating a feeding roller arm unit.
Figure 4:
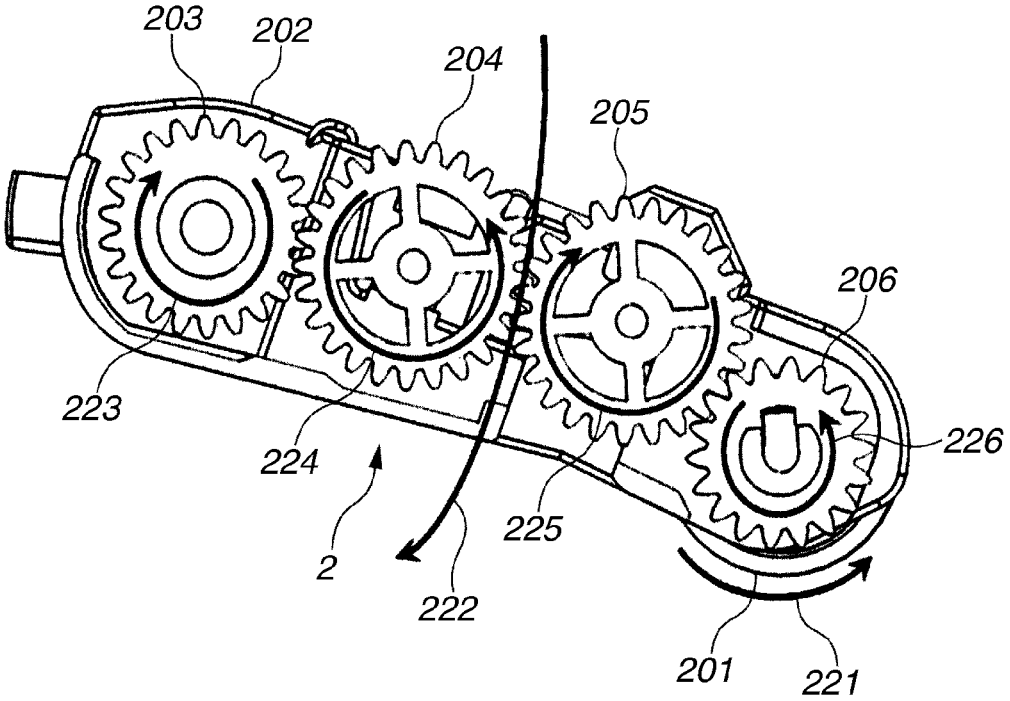
FIG. 4 is a schematic view illustrating a cross section of the feeding roller arm unit in FIG. 3.

With reference to FIGS. 3 and 4, the feeding roller arm unit 2 is described. FIG. 3 is a perspective view illustrating the feeding roller arm unit 2. FIG. 4 is a schematic view illustrating a cross section along the A-A' line in FIG. 3.

The feeding roller 201 is supported by a feeding roller arm 202. The feeding roller arm 202 is rotatably supported by a rotating shaft (not illustrated) relative to the body of the conveying apparatus. The feeding roller 201 is in contact with a sheet in the paper feed tray 11, due to the weights of the feeding roller 201 and the feeding roller arm 202. The conveying motor B5 is connected through a one-way clutch mechanism 207, a feeding gear 203, a sheet feeding and transferring gears 204 and 205, and a feeding roller gear 206, to transfer the driving force to the feeding roller 201.

When the conveying motor B5 gives driving force to the feeding gear 203 through the one-way clutch mechanism 207 in the direction illustrated by the arrow 223, the driving force is transmitted to rotate the sheet feeding and transferring gear 204 in the direction illustrated by the arrow 224, and rotate the sheet feeding and transferring gear 205 in the direction illustrated by the arrow 225. Subsequently, the driving force is transmitted from the sheet feeding and transferring gear 205 to the feeding roller gear 206 in the direction illustrated by the arrow 226, and is transmitted from the feeding roller gear 206 to the feeding roller 201 in the direction illustrated by the arrow 221. The feeding roller 201 utilizes the driving force and the friction between the feeding roller 201 and a sheet to convey the sheet to the U-turn path 10.

The rotations of the feeding roller 201, the feeding gear 203, the sheet feeding and transferring gears 204 and 205, and the feeding roller gear 206 sometimes get slowed due to conveyance resistance of sheets for example. If, in this state, driving force is applied to the feeding gear 203 in the direction illustrated by the arrow 223, a rotational force is generated which rotates the feeding roller arm unit 2 around the rotation shaft of the feeding roller arm 202 in the direction illustrated by the arrow 222, that is, in the direction toward the sheet. The rotational force presses the feeding roller 201, which is supported at the front edge of the feeding roller arm 202, against the sheet. As a result, the pressure contact force between the feeding roller 201 and the sheet increases, resulting in increase in the power with which the feeding roller 201 feeds the sheet.

Figure 5:
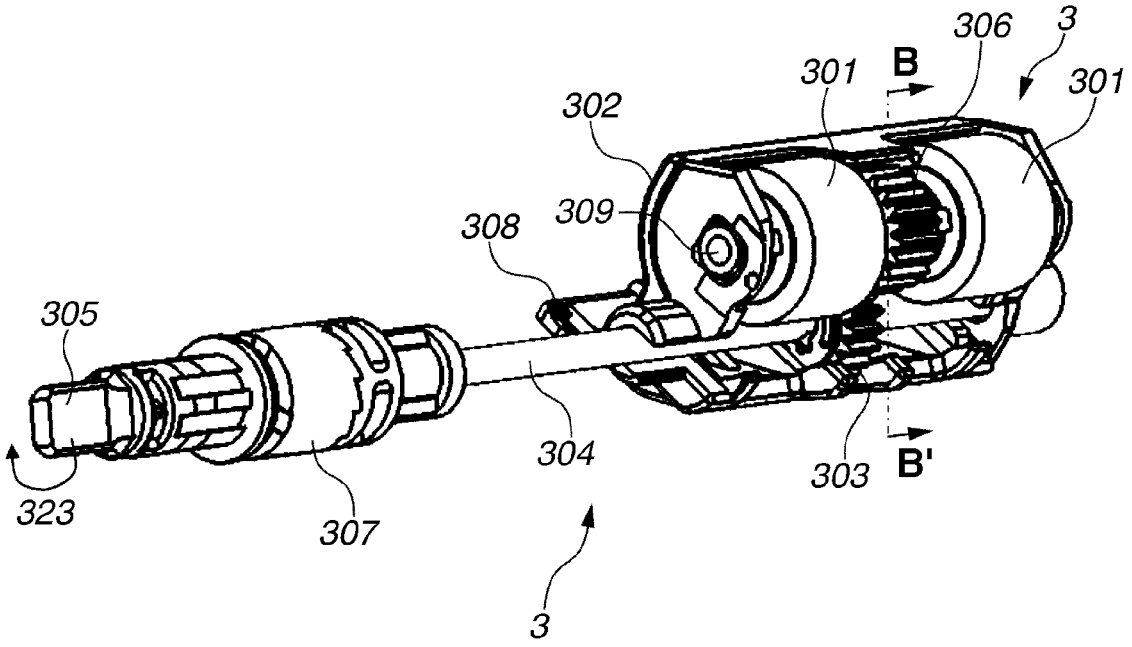
FIG. 5 is a schematic perspective view illustrating a structure of a drive roller arm unit.
Figure 6:
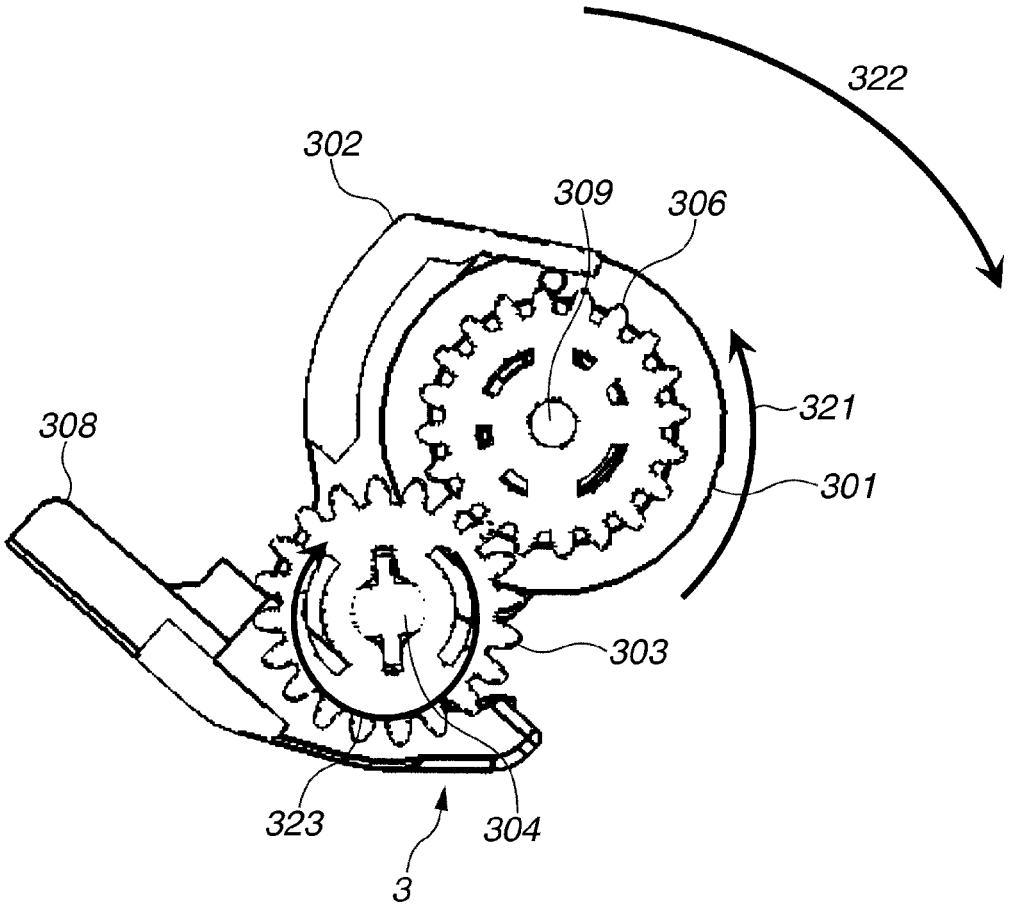
FIG. 6 is a schematic view illustrating a cross section along the line B-B' in FIG. 5.
Figure 7:
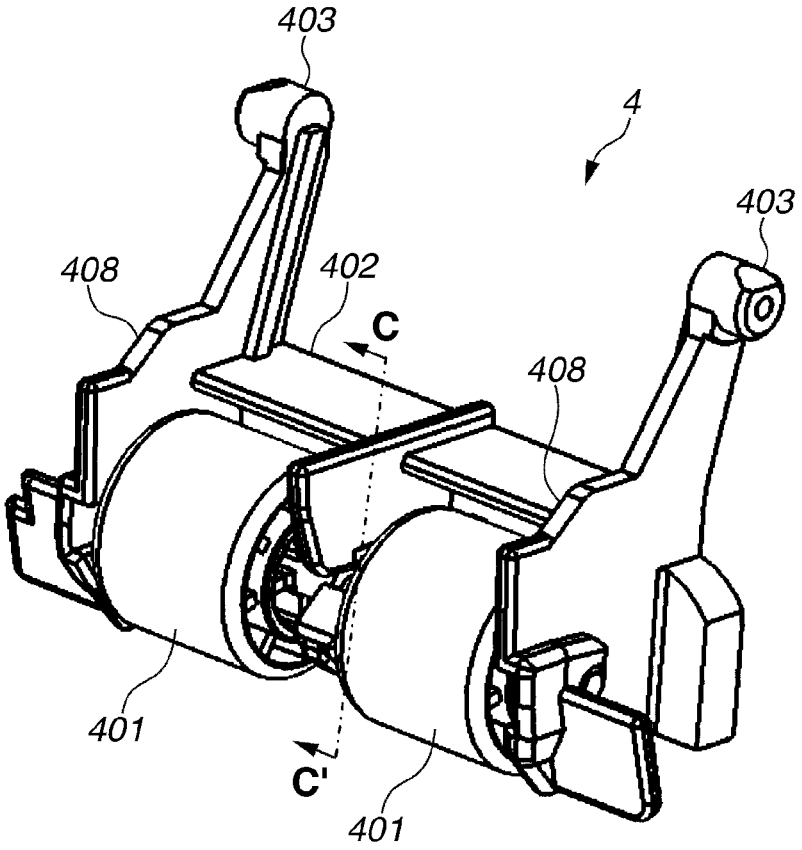
FIG. 7 is a schematic perspective view illustrating a structure of a driven roller arm unit.
Figure 8:
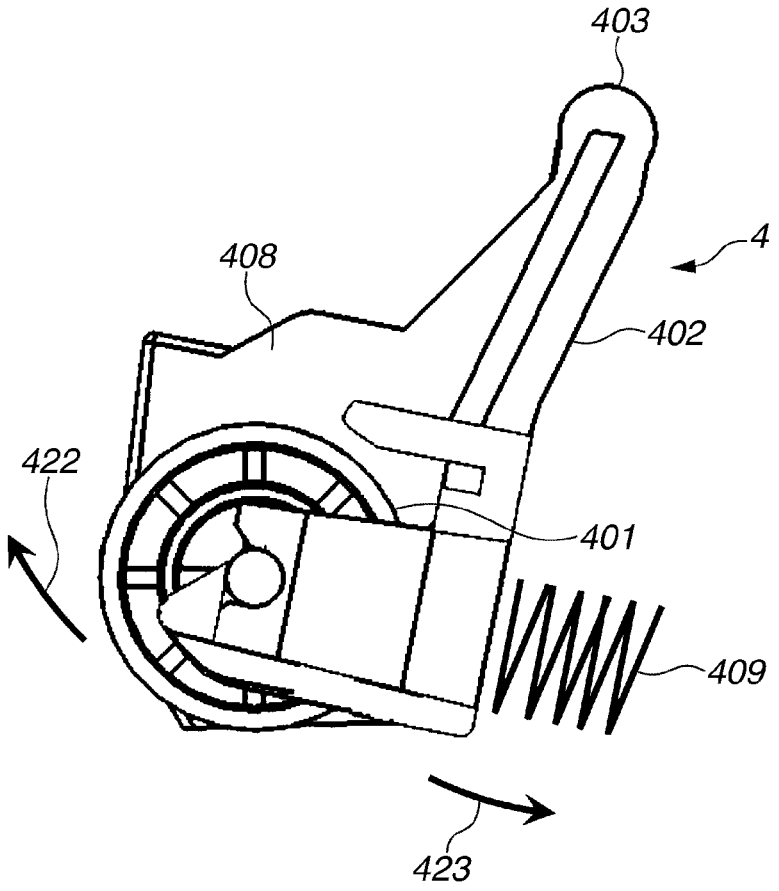
FIG. 8 is a schematic view illustrating a cross section along the line C-C' in FIG. 7.

With reference to FIGS. 5 to 8, a structure of the intermediate roller pair is described. FIG. 5 is a schematic perspective view illustrating a structure of a drive roller arm unit. FIG. 6 is a schematic view illustrating a cross section along the line B-B' in FIG. 5. FIG. 7 is a schematic perspective view illustrating a structure of a drive roller arm unit. FIG. 8 is a schematic view illustrating a cross section along the line C-C' in FIG. 7.

As described above, the roller pair includes the drive roller 301 and the driven roller 401 (see FIG. 2). The drive roller arm unit 3 including the drive roller 301 is described.

A driving force from a drive source (not illustrated) (i.e., the conveying motor B5) is transmitted in the direction illustrated by the arrow 323 to a transmission shaft 305. The driving force is then transmitted to a drive arm rotation shaft 304 through a drive arm clutch mechanism 307 that has a one-way clutch. The driving force is further transmitted to a drive gear 303 disposed around a drive arm rotation shaft 304, and a roller gear 306 and the drive roller 301 supported by a rotation shaft 309 on a drive arm 302 that is a first swing member. The drive arm rotation shaft 304 is rotatably supported by the inner guide 300 (see FIGS. 9 and 10) that is a part of an inner guide 502 of the U-turn path 10. Between the inner guide 300 and the drive arm 302, a weak spring (not illustrated) is disposed to press the drive roller arm 302 in the direction illustrated by the arrow 322 such that the drive roller 301 come in contact with the driven roller 401.

The rotations of the drive gear 303, the roller gear 306, and drive roller 301 sometimes get slowed due to conveyance resistance of sheets. If, in this state, driving force is applied to the drive gear 303 in the direction illustrated by the arrow 323 (i.e., the direction in which sheets are conveyed), a rotational force (moment) is generated in the drive arm unit 3 around the drive arm rotation shaft 304 in the direction illustrated by the arrow 322. As a result, the drive roller 301 supported by the drive roller arm 302 is pressed against the driven roller 401, increasing the pressure contact force of the intermediate roller pair. Hence, conveying force applied to sheets by the intermediate roller pair is increased.

Figure 9:
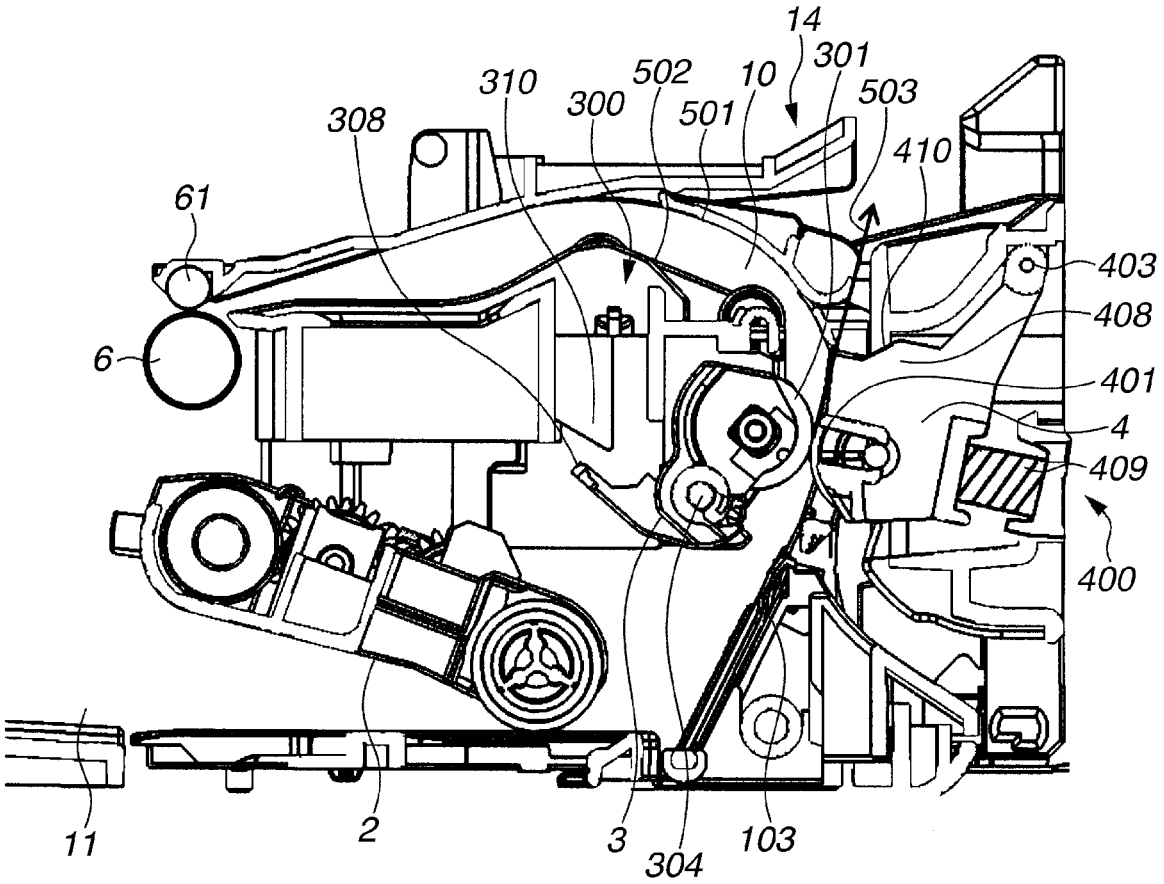
FIG. 9 is a schematic view illustrating a state where the nip direction of an intermediate roller pair is similar to the direction of sheets to be conveyed.
Figure 10:
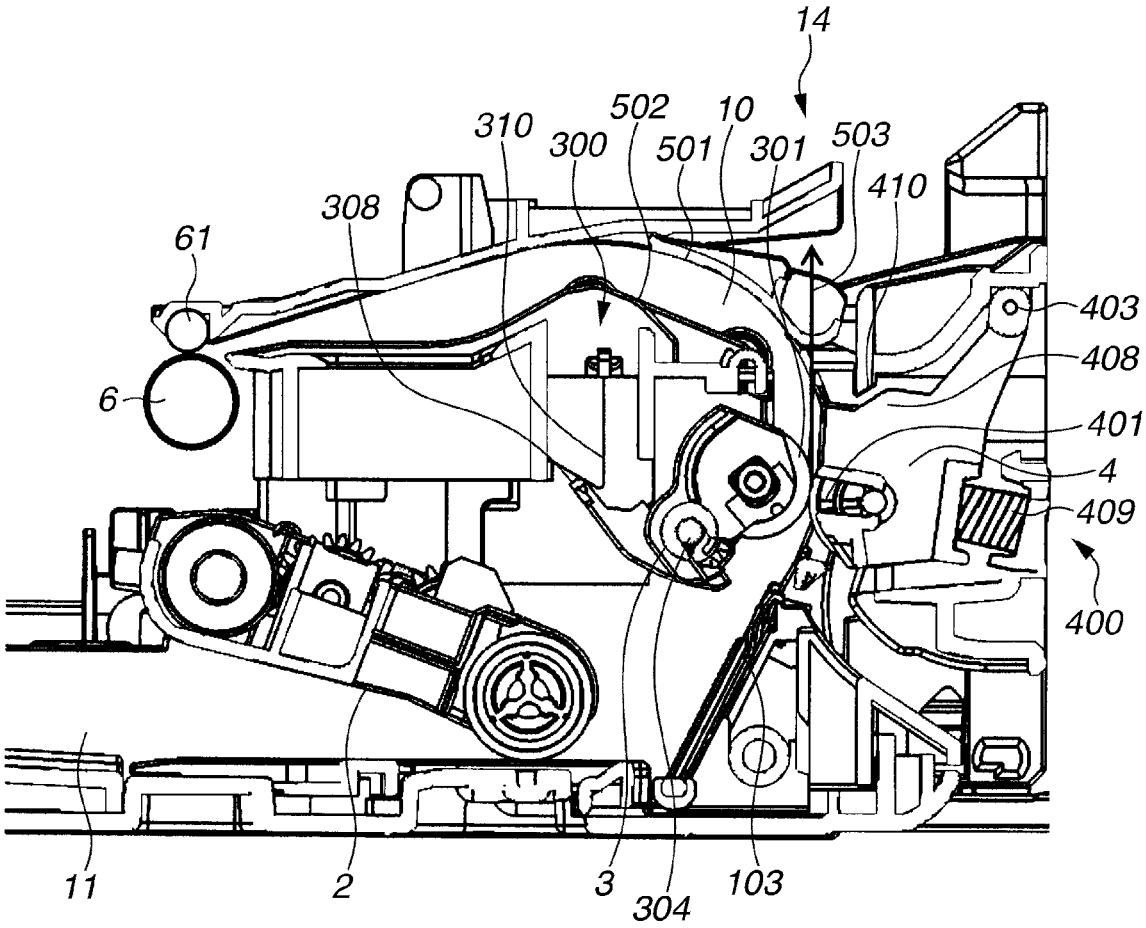
FIG. 10 is a schematic view illustrating a state where the nip direction of an intermediate roller pair is changed to be oriented toward the curved portion of a U-turn path.

The rotation of the drive arm unit 3 stops when a drive arm stopper 308 provided on the drive arm 302 meets an abutting portion 310 of the inner guide 300 (see FIGS. 9 and 10). The abutting portion 310 is a control member that limits rotation of the drive roller arm unit 3.

The driven roller arm unit 4 including the driven roller 401 is described. A driven arm rotation shaft 403 is rotatably supported by a rear guide 400 (see FIGS. 9 and 10) that is a part of an outer guide 501 of the U-turn path 10. The driven roller arm unit 4 is rotatable around a driven arm rotation shaft 403 mounted to the driven roller arm 402 that is a second swing member. The rotation of the driven roller arm unit 4 in the direction illustrated by the arrow 422 stops when a driven arm stopper 408 meets a rear guide stopper 410 mounted to the rear guide 400 (see FIGS. 9 and 10).

Between the rear guide 400 and the driven roller arm 402, a compressing spring 409 is disposed to press the driven roller arm 402 in the direction illustrated by the arrow 422. When the driven roller arm 402 is not subject to a pressing force from the drive roller 301 caused by conveyance resistance which will be described below, the driven arm stopper 408 is in contact with the rear guide stopper 410 provided in the rear guide 400.

The driven roller 401 is supported by the driven roller arm 402, and rotates only under the rotation force of the drive roller 301 and the pressing force of the drive roller arm 302, without connection to the conveying motor B5 through gears.

With reference to FIGS. 9 and 10, changes in nip direction of the intermediate roller pair are described. In FIG. 9, the nip direction of an intermediate roller pair is almost in line with the direction of sheets to be conveyed. In FIG. 10, the nip direction of an intermediate roller pair is changed to be oriented toward the inner side of the curved portion of a U-turn path.

The nip direction herein refers to a direction perpendicular to a straight line between the rotation shafts of the rollers 301 and 401 within a cross section perpendicular to the rotation shafts of the drive roller 301 and the driven roller 401. The nip direction extends from upstream to downstream of the intermediate roller pair. In other words, the nip direction is coincident with the direction of conveying force applied to sheets by the intermediate roller pair at its nip point. The nip direction is also coincident with the direction of a common tangent at the nip point between the drive roller 301 and the driven roller 401 within a cross section perpendicular to the rotation shafts of the two rollers 301 and 401.

The pressing force of the drive roller arm unit 3 caused by the spring (not illustrated) is smaller than that of the driven roller arm unit 4 caused by the spring 409. Hence, while the intermediate roller pair is not pinching a sheet and the drive roller 301 is not operating, the driven roller arm unit 4 is biased in the direction illustrated by the arrow 422 (see FIG. 8) and the driven arm stopper 408 is in contact with the rear guide stopper 410. In addition, the drive roller 301 is in contact with the driven roller 401.

While the intermediate roller pairs are not pinching a sheet, when a driving force is transmitted from the conveying motor B5 to the drive gear 303, the drive roller 301 starts to rotate. The driven roller 401 in contact with the drive roller 301 is smoothly supported by the driven roller arm 402, and thereby the driven roller 401 starts to rotate as drive roller 301 rotates. Since the rotations of the drive roller 301 and the driven roller 401 generate little resistance, the drive roller 301 is not adversely affected by conveyance resistance. Accordingly, the drive roller arm unit 3 does not rotate, and the positional relationship between the drive roller 301 and the driven roller 401 remains the same as in the state where the drive roller 301 is not operating.

Accordingly, when a sheet is not being conveyed, regardless of presence/absence of transmission of a driving force, the nip direction 503 of the intermediate roller pair forms only a small angle with an inclined plate 103 located upstream of the intermediate roller pair. In other words, the conveying direction in which sheets are conveyed from an upstream side of the intermediate roller pair, is almost same as the nip direction 503 of the intermediate roller pair. Thus, when sheets are fed, a driving force is transmitted to both of the feeding roller 201 and the drive roller 301 as described above, and when a sheet conveyed by the feeding roller 201 reaches the nip point between the intermediate roller pair, the sheet's leading edge is smoothly drawn into the nip between the intermediate roller pair.

The sheet pinched between the intermediate roller pair then reaches the curved portion of the U-turn path 10, where the sheet is guided by the outer guide 501 to run along the curved portion. During the running along the curved portion, the sheet pinched between the intermediate roller pair tries to go straight along the nip direction, and thereby rubs the curved outer guide 501 located downstream of the intermediate roller pair. Accordingly, the sheet is guided being curved by the outer guide 501. As a result, friction between the sheet and the outer guide 501 causes conveyance resistance. The conveyance resistance, in turn, generates a rotation force of the drive roller arm unit 3 in the direction illustrated by the arrow 322 (see FIG. 6), as described above, increasing the pressure contact force of the nip between the intermediate roller pair.

Figure 13A:
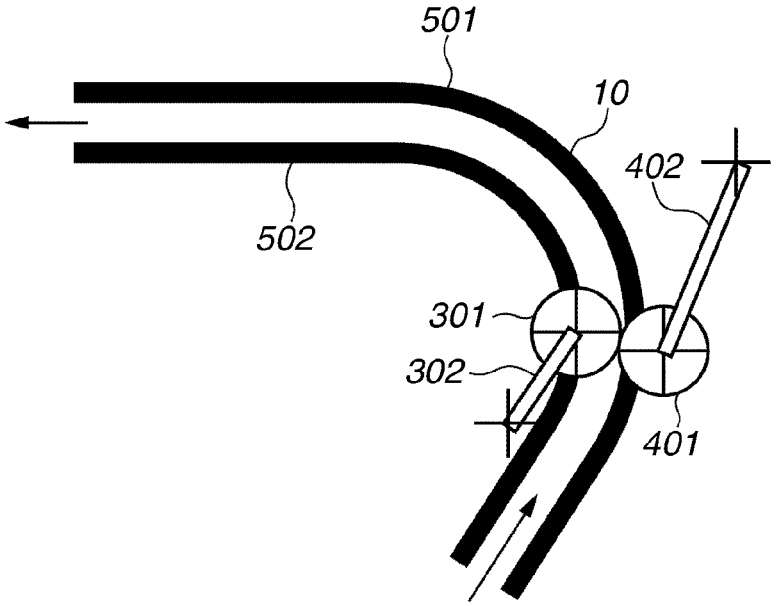
FIGS. 13A and 13B are schematic views illustrating positional relationship between a drive roller and a driven roller.

The positional relationship between the nip point of the intermediate roller pair, and the rotation shafts of the drive roller 301 and the driven roller 401 is described. When no conveyance resistance is present, the rotation shaft of the drive roller 301 is located downstream, and the shaft of the driven roller 401 is located upstream respectively in the sheet conveying direction (see FIG. 13A).

When a pressing force of the drive roller arm unit 3 due to conveyance resistance increases to overcome the pressing force of the spring 409, the drive roller arm unit 3 rotates in the direction illustrated by the arrow 322 to squeeze the driven roller arm unit 4. Along with the rotation of the drive roller arm unit 3, the driven roller arm unit 4 rotates around the driven arm rotation shaft 403 in the direction illustrated by the arrow 423. In other words, the driven roller arm unit 4 moves as the drive roller arm unit 3 moves.

Figure 13B:
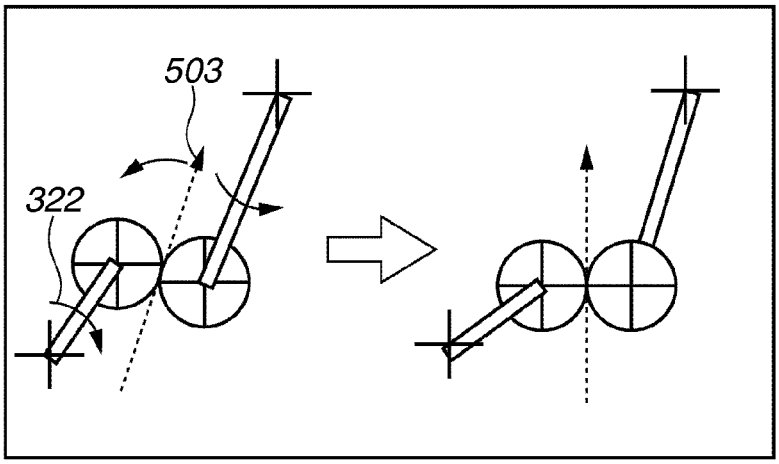

The rotation of the drive roller arm unit 3 and the driven roller arm unit 4 causes both of the drive roller 301 and the driven roller 401 to move toward an upstream portion in the sheet conveying direction. The movement toward an upstream side of the drive roller 301 in the sheet conveying direction due to the rotation is larger than that of the driven roller 401. Accordingly, the position of nip point between the intermediate roller pair is displaced. Thus, the nip direction 503 of the intermediate roller pair that matches the direction of conveying force applied to sheets at the nip point is displaced toward the inner guide 502, that is, toward the inner side (inner periphery side) of the curved portion of the U-turn path 10 (see FIG. 13B).

In other words, a tangent that is common to the drive roller 301 and the driven roller 401 passes at a nip point between the rollers. The portion of the tangent located downstream of the nip point moves toward the inner periphery of the conveyance path in a cross section perpendicular to each rotation shaft of the drive roller 301 and the driven roller 401. As a result, the friction between sheets and the outer guide 501 due to rubbing and the force required to curve the sheets along the shape of the U-turn path 10 are reduced, decreasing conveyance resistance and facilitating conveyance of the sheets.

Figure 12:
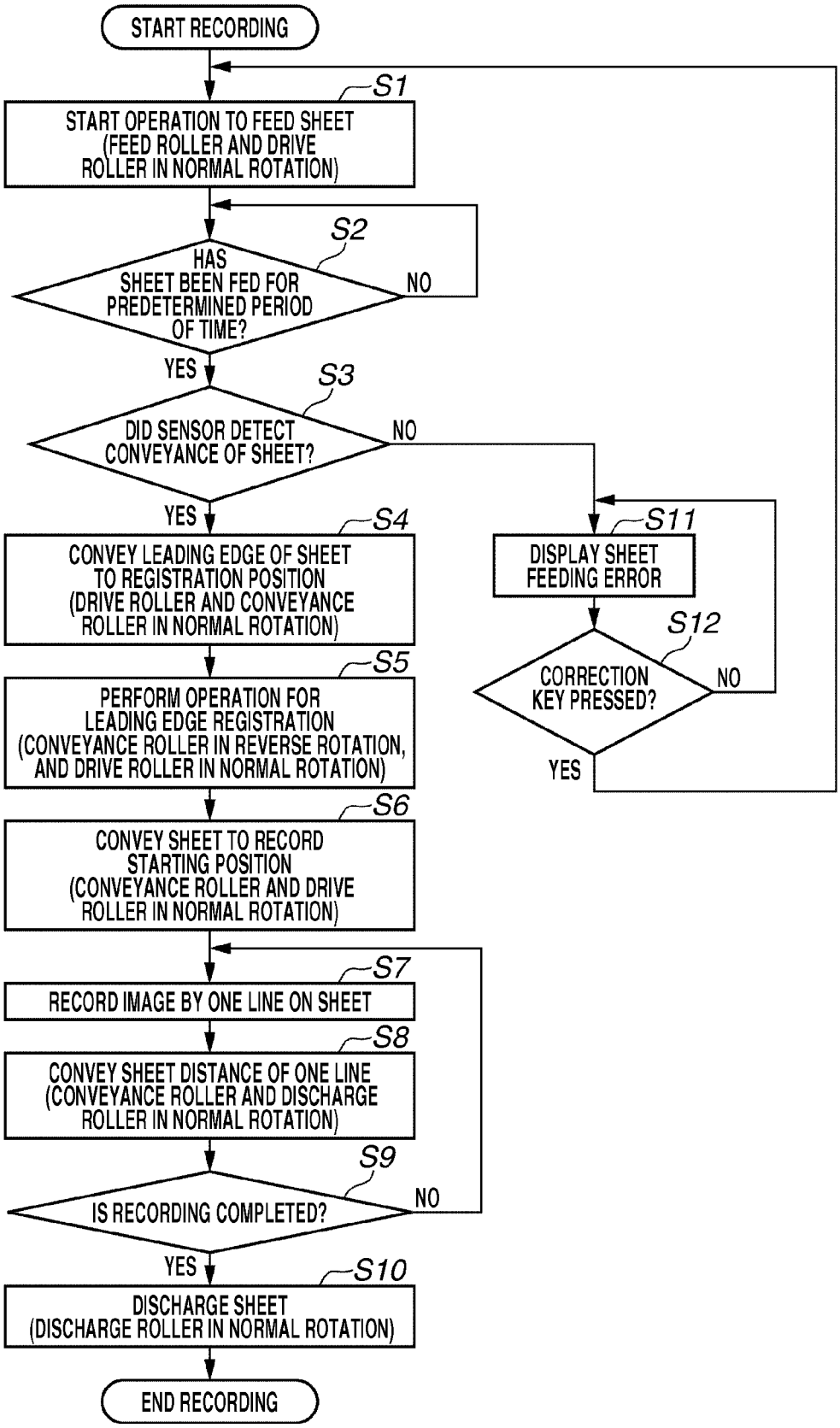
FIG. 12 is a schematic flowchart illustrating recording operations of a recording apparatus.

Operations to convey sheets by a conveying apparatus according to the present invention are described with reference to the schematic flowchart illustrating recording operations of the recording apparatus in FIG. 12.

In step S1, a command to start recording is issued from a computer for example to the control unit B1. The control unit B1 sends the command to the motor driver B2. Based on the command, the conveying motor B5 serving as a conveyance drive source is driven to transmit driving force to each of the feeding roller arm unit 2, the drive roller arm unit 3, the conveyance roller 6, and the sheet discharge roller 8. The feeding roller arm unit 2, after receiving the driving force from the conveying motor B5, transmits the force to the feeding roller 201. The feeding roller 201, which is in contact with the sheets stacked in the paper feed tray 11, is rotated by the transmitted driving force, and pushes the sheets one after another toward the U-turn path 10 for conveyance.

The sheets conveyed by the feeding roller 201 are separated, for example, by an inclined separation plate 103, and individually advance along the plate 103 to the intermediate roller pair including the drive roller 301 and the driven roller 401.

In the case where the direction of the sheet conveyance is almost similar to the nip direction 503 of the intermediate roller pair, when the sheets are drawn into the intermediate roller pair, the driving force is cancelled by the drive switching and transferring system B8, and is not transmitted to the feeding roller 201. The feeding roller 201 then starts to idle due to the one-way clutch mechanism 207, and thereby the sheets are conveyed only by the intermediate roller pair.

When the leading edge of each sheet is discharged from the intermediate roller pair, because little conveyance resistance is caused at this point of time, the sheet advances in the nip direction 503 that is coincident with the direction the leading edge of the sheet is drawn into the roller pairs. When the sheet's leading edge meets the outer guide 501 that shapes the U-turn path 10, the sheet is conveyed to the downstream side, with its leading edge rubbing the outer guide 501, toward the conveyance roller pair having the conveyance roller 6. During the conveyance, the conveyance resistance increases, and thereby the drive roller arm unit 3 and the driven roller arm unit 4 are rotated, which orients the nip direction 503 of the intermediate roller pair toward the curved portion of the U-turn path 10. This change in orientation causes change in the sheet conveying direction.

In step S2, each sheet is continually conveyed to reach the nip point between the conveyance roller pair including the conveyance roller 6 and the pinch roller 61. In step S3, if the sensors B14 do not detect the sheet's leading edge at the nip point between the conveyance roller pair for a predetermined period of time, in step S11, information of sheet feeding error is displayed to prompt a user to start operation for error correction. In step S12, when an operation for error correction is received from a user, the recording apparatus restarts the sheet feeding operation in step S1.

In step S4, when the sensors B14 detect a sheet's leading edge passing the nip point of the conveyance roller pair, in step S5, the recording apparatus selects an appropriate manner of registration adjustment of the sheet's leading edge according to the type of the conveyed sheet. The recording apparatus corrects the direction of the sheet's leading edge to be perpendicular to the axis of the conveyance roller 6. In step S6, the conveyance roller 6 draws the sheet therein to convey it to a record starting position on the platen 7.

The conveyance roller pair conveys sheets at a speed higher than the intermediate roller pair. The drive transferring system of the drive roller 301 includes the drive arm clutch mechanism 307 that stops transmission of driving force when the drive roller 301 is dragged by a sheet that is being conveyed by the conveyance roller pair. Accordingly, when the conveyance roller pair starts to convey a sheet, no driving force is transmitted to the drive roller 301, so that the sheet is conveyed only by the conveyance roller pair.

In step S7, when each sheet reaches a record starting position, the recording head unit 9 discharges ink to the sheet while moving above the sheet to form an image for one line onto the sheet. After completion of recording one line, in step S8, the sheet is conveyed a distance of one line. In step S9, it is determined whether image formation is completed. If not (NO in step S9), recording and conveyance of the sheet for one line is repeated until the image formation is completed. After completion of image formation, in step S10, the sheet discharge roller 8 discharges the sheet to the discharge tray 13.

As described above, a conveying apparatus according to the present invention is able to change the nip direction of an intermediate roller pair between before and after generation of conveyance resistance. This facilitates smooth conveyance of sheets. Further, since the sheets can be more adequately drawn into the intermediate roller pair, so that reliability of sheet conveyance is increased. The change in nip direction does not require additional elements such as a drive source or a massive mechanism, so that increase in size and cost of the conveying apparatus can be prevented.

Figure 14A:
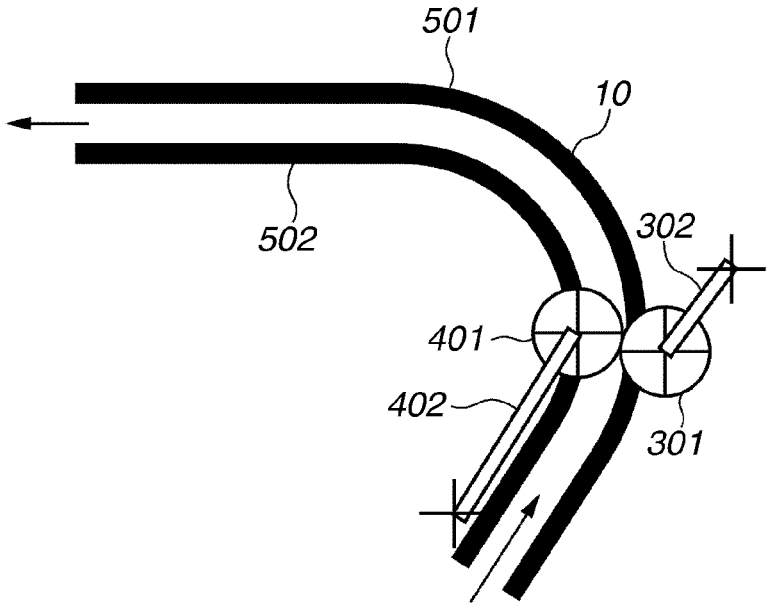
FIGS. 14A and 14B are schematic views illustrating positional relationship between a drive roller and a driven roller in a conveying apparatus of a second exemplary embodiment according to the present invention.
Figure 14B:
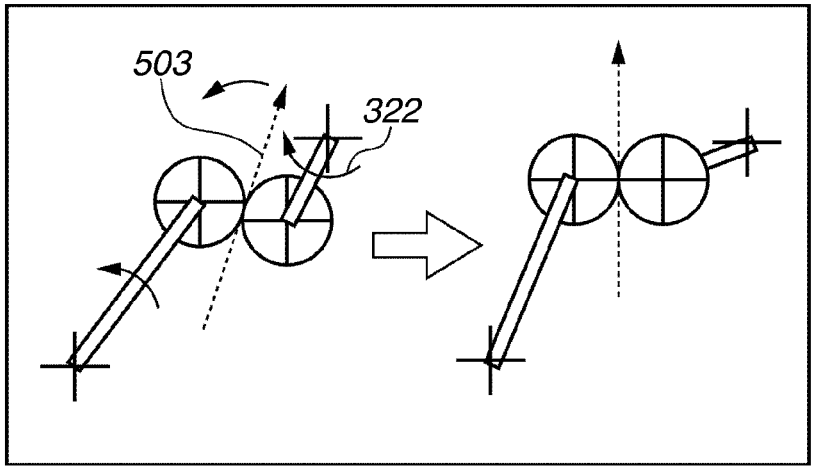

With reference to FIG. 14, a conveying apparatus according to a second exemplary embodiment is described. FIGS. 14A and 14B are schematic views illustrating a positional relationship between a drive roller and a driven roller in the conveying apparatus of the second exemplary embodiment according to the present invention. FIG. 14A is a schematic view illustrating a positional relationship between a drive roller and a driven roller before meeting conveyance resistance. FIG. 14B is a schematic view illustrating a positional relationship between a drive roller and a driven roller that is changed after meeting the conveyance resistance. The structures of the second exemplary embodiment similar to those of the first exemplary embodiment are not described.

In the intermediate roller pair of the present exemplary embodiment, a drive roller arm unit 3 and a driven roller arm unit 4 are arranged such that a drive roller 301 is disposed on a side of an outer guide 501 of a U-turn path 10, and a driven roller 401 is disposed on a side of an inner guide 502 of a U-turn path 10. With respect to the nip point between the intermediate roller pair and the rotation shafts of the drive roller 301 and the driven roller 401, when there is no conveyance resistance, the rotation shaft of the drive roller 301 is located upstream, and the rotation shaft of the driven roller 401 is located downstream, in the sheet conveying direction.

When a sheet is conveyed being sandwiched between the intermediate roller pair and conveyance resistance occurs due to friction between the outer guide 501 and the sheet, a force is generated that rotates the drive roller arm unit 3 in the direction illustrated by the arrow 322 for the same reason as described in the first exemplary embodiment. As a result, the drive roller 301 presses the driven roller 401.

Accordingly, both of the drive roller 301 and the driven roller 401 move to a downstream side in the sheet conveying direction. In this movement, the drive roller 301 moves further to the downstream side than the driven roller 401. Thus, the nip point between the intermediate roller pair varies, and the nip direction 503 is changed to be oriented toward the inner guide 502, that is, to the inner side of the curve, of the U-turn path 10. As a result, the friction force that occurs when sheets' leading edges rub the outer guide 501 of the U-turn path 10 and the force required to curve the sheets along the shape of the U-turn path 10 are reduced, decreasing conveyance resistance.

Figure 15A:
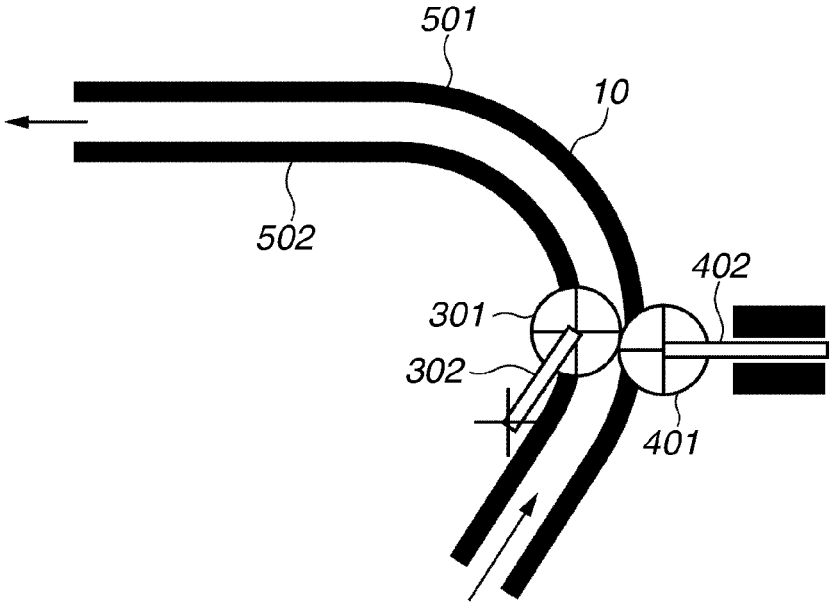
FIGS. 15A and 15B are schematic views illustrating positional relationship between a drive roller and a driven roller in a conveying apparatus of a third exemplary embodiment according to the present invention.
Figure 15B:
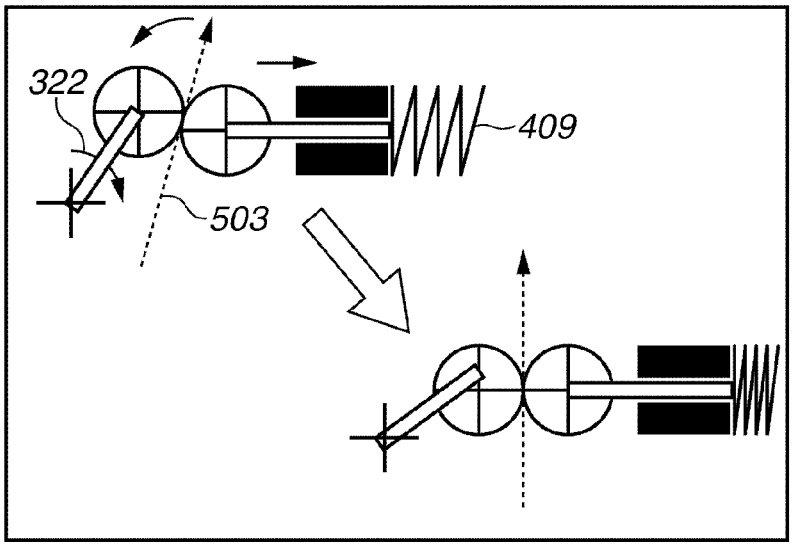

With reference to FIG. 15, a conveying apparatus according to a third exemplary embodiment is described. FIGS. 15A and 15B are schematic views illustrating a positional relationship between a drive roller and a driven roller in the conveying apparatus of the third exemplary embodiment according to the present invention. FIG. 15A is a schematic view illustrating a positional relationship between a drive roller and a driven roller before meeting conveyance resistance. FIG. 15B is a schematic view illustrating a positional relationship between a drive roller and a driven roller that is changed after meeting conveyance resistance. The structures of the third exemplary embodiment similar to those of the above exemplary embodiments are not described.

As in the first exemplary embodiment, in an intermediate roller pair, a drive roller 301 is disposed on the side of an inner guide 502 of a U-turn path 10, and a driven roller 401 is disposed on the side of an outer guide 501. When there is no conveyance resistance, the rotation shaft of the drive roller 301 is located downstream, and the rotation shaft of the driven roller 401 is located upstream in the sheet conveying direction.

As in the first exemplary embodiment, a drive roller arm unit 3 having the drive roller 301 is rotatably supported by an inner guide 300. Unlike the first exemplary embodiment, the driven roller 401 is pivotally supported by a driven roller arm 402. The driven roller arm 402 is disposed in a straight slidable manner and perpendicular to the portion of the outer guide 501 opposite to the driven roller 401. The driven roller 401 is under pressure toward the drive roller by a spring 409 through the driven roller arm 402. As in the first exemplary embodiment, the pressing force exerted by the spring 409 is larger than the pressing force exerted onto the drive roller 301 by a spring (not illustrated) pressing them toward the driven roller 401.

When a sheet is conveyed being sandwiched between the intermediate roller pair, conveyance resistance occurs, which generates a force that rotates the drive roller arm unit 3 as described in the first exemplary embodiment. As a result, the drive roller 301 presses the driven roller 401. When the pressing force of the drive roller 301 overcomes that of the spring 409, the drive roller 301 moves to an upstream side in the sheet conveying direction, and the driven roller 401 is moved outward straight as the drive roller 301 moves.

Although the drive roller 301 moves to the upstream side, the driven roller 401 does not move downward, so that the nip direction 503 of the intermediate roller pair shifts toward the inner guide 502. As a result, the friction force that occurs when sheets' leading edges rub the outer guide 501 of the U-turn path 10, and the force required to curve the sheets along the shape of the U-turn path 10 are reduced, decreasing conveyance resistance.

Figure 16A:
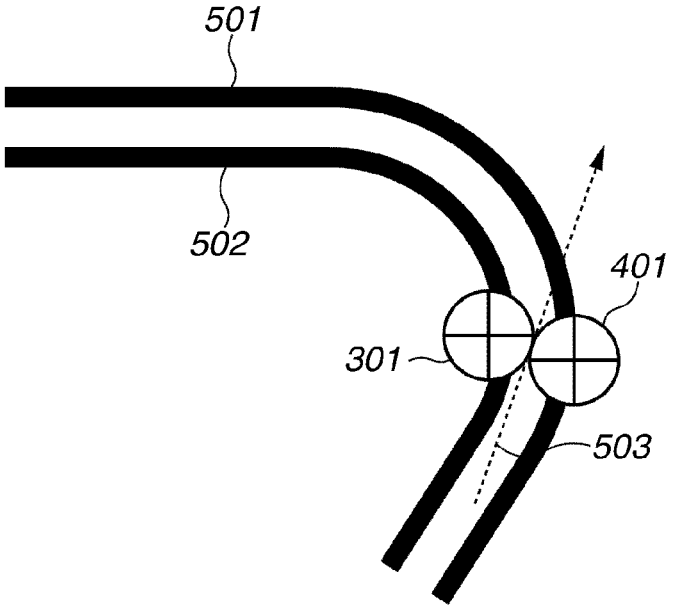
FIGS. 16A and 16B illustrate a fourth exemplary embodiment.
Figure 16B:
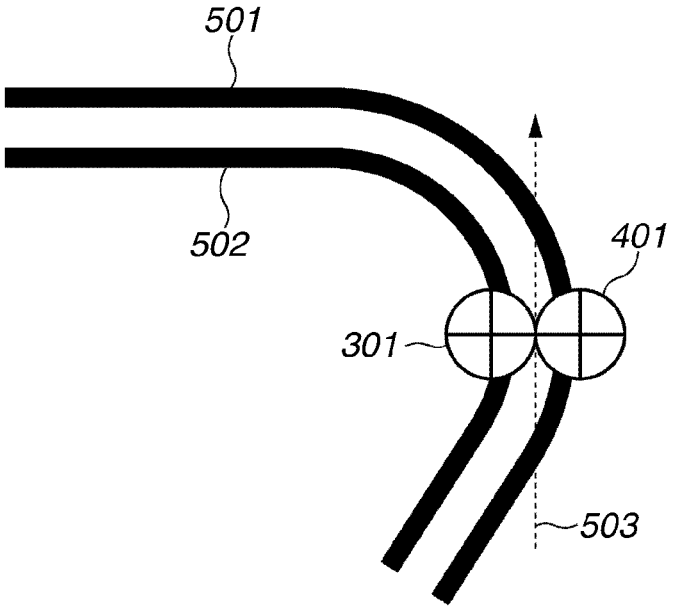

In the above exemplary embodiments, both of the drive roller 301 and the driven roller 401 are displaced to change the nip direction. In contrast, it is possible to change the nip direction by displacing only one of the drive roller 301 and the driven roller 401 while the other staying at the same position. FIGS. 16A and 16B illustrate a fourth exemplary embodiment in which drive roller 301 is not displaced, but only driven roller 401 is displaced.

FIG. 16A illustrates a state of the drive roller 301 and the driven roller 401 with no sheet sandwiched therebetween. FIG. 16B illustrates a state of the drive roller 301 and the driven roller 401 with a sheet (not illustrated) sandwiched therebetween. In the state illustrated in FIG. 16A, when the drive roller 301 and the driven roller 401 pinch a sheet therebetween, as illustrated in FIG. 16B, the drive roller 301 stays there, but only the driven roller 401 moves to a downstream side from the position illustrated in FIG. 16A. The movement changes the orientation of the nip toward the inner guide 502, reducing the conveyance resistance onto the sheet caused by the outer guide 501.

Alternatively, the driven roller 401 may be located on the inner side, and the drive roller 301 may be located on the outer side of the curved portion of the conveyance path so that only the drive roller 301 is displaced.

The movement of the rollers may be achieved by a cam that is rotated by a drive source, a link mechanism, or a solenoid, as well as by driving force of a drive roller as in the above exemplary embodiments.

Figure 17A:
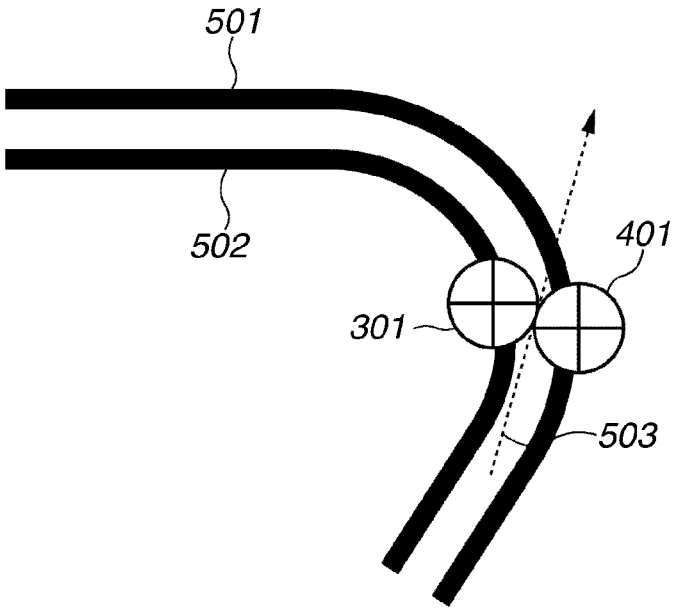
FIGS. 17A and 17B illustrate a fifth exemplary embodiment.
Figure 17B:
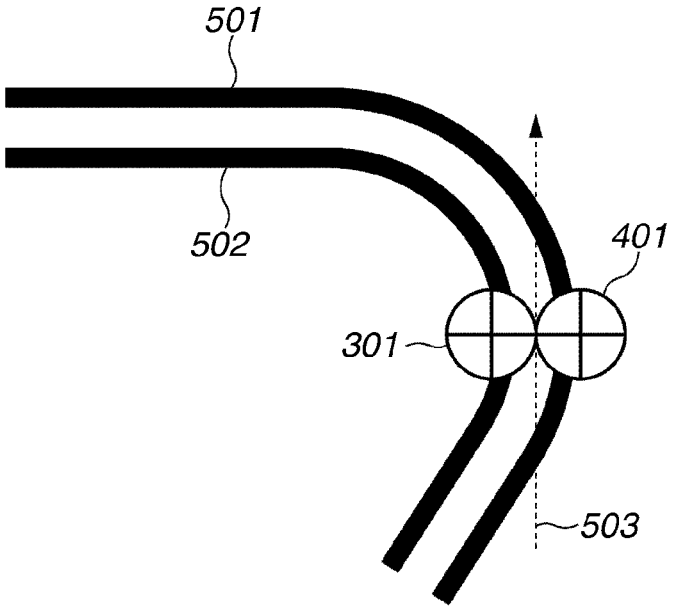
Figure 18A:
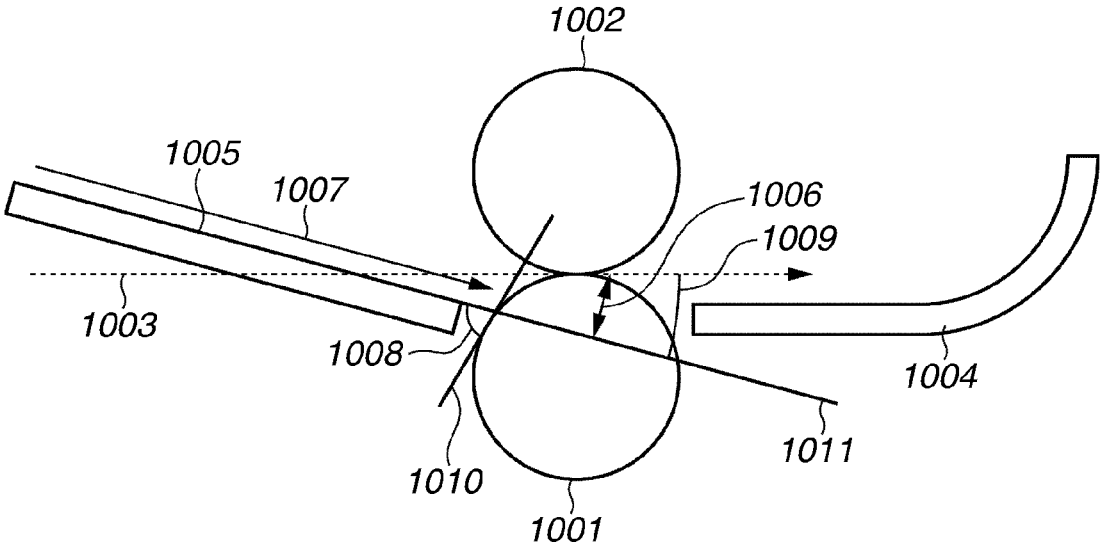
FIGS. 18A and 18B schematically illustrate arrangement of a conveyed sheet and an intermediate roller pair.
Figure 18B:
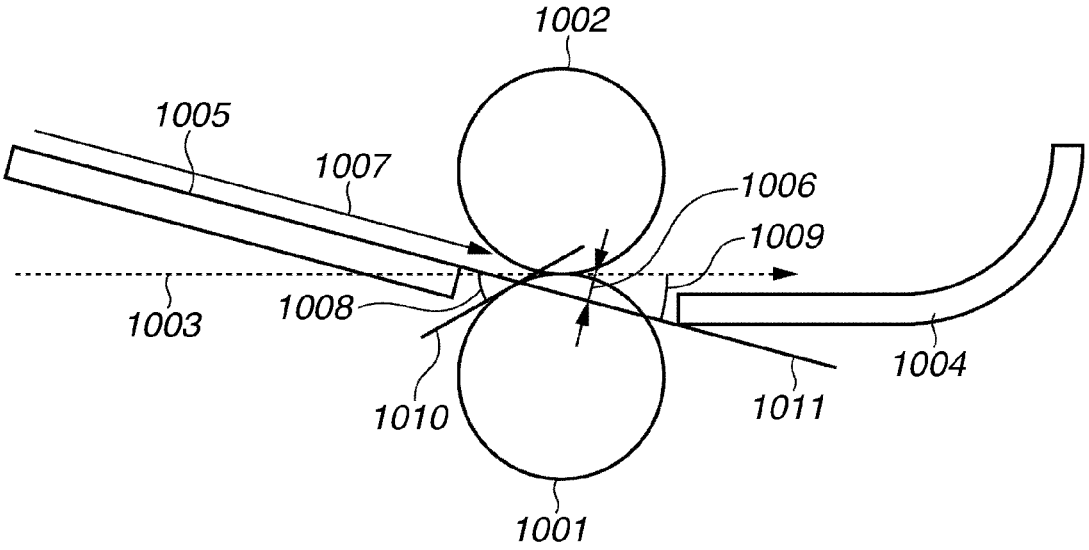
Figure 19A:
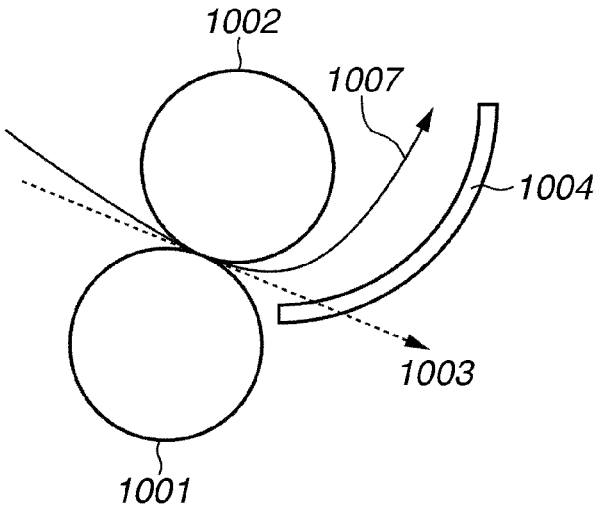
FIGS. 19A and 19B schematically illustrate a nip direction of an intermediate roller pair and a direction of a sheet conveyed by the intermediate roller pair.
Figure 19B:
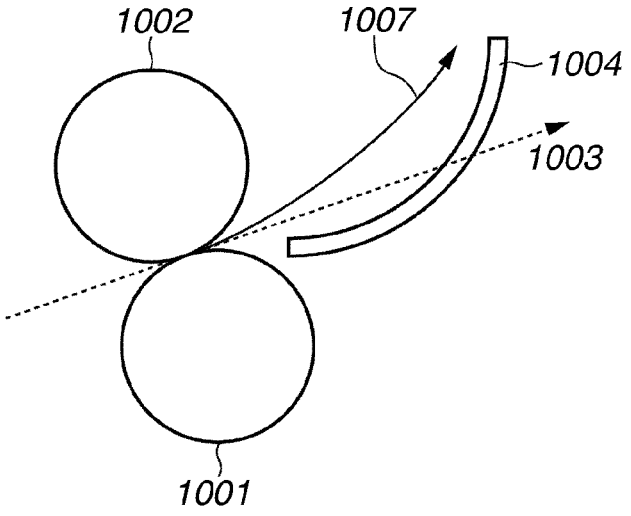

FIG. 17 illustrates a fifth exemplary embodiment in which the driven roller 401 stays, but only the drive roller 301 is displaced. FIG. 17A illustrates a state of the drive roller 301 and the driven roller 401 with no sheet sandwiched therebetween. FIG. 17B illustrates a state of the drive roller 301 and the driven roller 401 with a sheet (not illustrated) sandwiched therebetween. In the state illustrated in FIG. 17A, when the drive roller 301 and the driven roller 401 pinch a sheet therebetween, as illustrated in FIG. 17B, the driven roller 401 stays there, but only the drive roller 301 moves to the upstream side from the position illustrated in FIG. 16A. The movement changes the orientation of the nip toward the inner guide 502, reducing the conveyance resistance caused by the outer guide 501 onto the sheet.

Alternatively, the driven roller 401 may be located on the inner side, and the drive roller 301 may be located on the outer side of the curved portion of the conveyance path, so that only the driven roller 401 is displaced.

The movement of the rollers may be achieved by a cam that is rotated by a drive source, a link mechanism, or a solenoid, as well as by driving force of a drive roller as in the above exemplary embodiments.

In the second to fifth exemplary embodiments, the nip direction of the intermediate roller pair is also changed between before and after generation of conveyance resistance. This facilitates smooth conveyance of sheets and smooth drawing of sheets into an intermediate roller pair. Further, the sheets can be more adequately drawn into an intermediate roller pair, so that reliability of sheet conveyance is increased. The change in nip direction does not require additional elements such as a drive source or a massive mechanism, preventing increase in size and cost of the conveying apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-179471 filed Aug. 19, 2011, which is hereby incorporated by reference herein in its entirety.

What is claimed is:

1. A conveying apparatus, comprising:

a sheet conveyance path including a curved portion having an inner guide and a outer guide;

a roller pair including a first roller located on the inner guide and a second roller located on the outer guide and configured to pinch a sheet; and a mechanism configured to move the first roller to an upstream side with respect to a sheet conveying direction by a first amount and move the second roller to the upstream side with respect to the sheet conveying direction by a second amount which is smaller than the first amount after the roller pair pinches the sheet, wherein the first roller is a drive roller that is supported by a swing member and rotates by a drive force transmitted from a drive source, and when conveyance resistance of the sheet increases, the drive force swings and swing member.

2. The conveying apparatus according to claim 1, wherein the mechanism causes at least one of the two rollers included in the roller pair to move such that a tangent that is common to the rollers, passes a nip point between the rollers, and the portion of the tangent located downstream of the nip point moves toward an inner periphery of the conveyance path, in a cross section perpendicular to each rotational axis of the two rollers, so that an orientation of a conveying force of the roller pair is changed.

3. The conveying apparatus according to claim 1, wherein after the roller pair pinches the sheet, the second roller follows the first roller and moves to the upstream side by the second amount.

4. The conveying apparatus according to claim 1, wherein the second roller is a driven roller that moves following the first roller.

5. The conveying apparatus according to claim 1, wherein the swing member swings according to the conveyance resistance caused by the sheet.

6. The conveying apparatus according to claim 5, wherein, when the first roller is not subject to the conveyance resistance, the rotational axis of the first roller is located downstream of the rotational axis of the second roller in the sheet conveying direction, and while the first roller is subject to the conveyance resistance, the first roller moves to the upstream side in the sheet conveying direction as compared to the location of the first roller when not subject to the conveyance resistance.

7. The conveying apparatus according to claim 6, wherein the second roller is supported by a second swing member.

8. A recording apparatus, comprising a conveying apparatus according to claim 1, and a recording unit that records images on the sheets.

9. A recording apparatus comprising:

a recording head configured to record images on a sheet;

a conveying roller located upstream of the recording head in a sheet conveying direction and configured to convey the sheet;

a feeding roller located upstream of the conveying roller in the sheet conveying direction and configured to feed the sheet;

a sheet conveyance path located between the feeding roller and the conveying roller and including a curved portion having an inner guide and an outer guide;

a first roller located on the inner guide, the first roller being a drive roller that rotates by a drive force transmitted from a drive source;

a first swing member configured to support the first roller, wherein the drive force from the drive source swings the first swing member when conveyance resistance of the sheet increases;

a second roller located on the outer guide; and a moving unit configured to move the first roller to an upstream side with respect to the sheet conveying direction by a first amount and move the second roller to the upstream side with respect to the sheet conveying direction by a second amount which is smaller than the first amount.

10. The recording apparatus according to claim 9, wherein the second roller is a driven roller that moves following the first roller.

11. The recording apparatus according to claim 10, further comprising a second swing member configured to support the second roller.

* * * * *